US007425929B2

(12) United States Patent
Sako

(10) Patent No.: US 7,425,929 B2
(45) Date of Patent: Sep. 16, 2008

(54) COIL ANTENNA

(75) Inventor: Yoshihiro Sako, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/566,264

(22) Filed: Dec. 4, 2006

(65) Prior Publication Data

US 2007/0091007 A1 Apr. 26, 2007

Related U.S. Application Data

(63) Continuation of application No. PCT/JP2006/313205, filed on Jul. 3, 2006.

(30) Foreign Application Priority Data

Aug. 4, 2005 (JP) ..... 2005-227153

(51) Int. Cl.
*H01Q 7/08* (2006.01)

(52) U.S. Cl. ..... 343/788; 343/787; 343/872

(58) Field of Classification Search ..... 343/788, 343/787, 872
See application file for complete search history.

(56) References Cited

U.S. PATENT DOCUMENTS 3,111,669 A * 11/1963 Walsh ..... 342/362
3,778,836 A * 12/1973 Tanaka ..... 343/702
3,965,474 A * 6/1976 Guerrino et al. ..... 343/719
6,400,330 B1 6/2002 Maruyama et al.
7,088,249 B2 8/2006 Senba et al.
7,095,381 B2 8/2006 Kimura et al.
2002/0033777 A1 3/2002 Maruyama et al.

FOREIGN PATENT DOCUMENTS

JP 06-005439 A 1/1994
JP 07-272952 A 10/1995
JP 11-026654 A 1/1999
JP 2001-345615 A 12/2001
JP 2001-355358 A 12/2001
JP 2001-358522 A 12/2001
JP 2002-118490 A 4/2002
JP 2004-031051 A 1/2004
JP 2005-158291 A 6/2005
JP 2005-295473 A 10/2005

OTHER PUBLICATIONS

Official Communication issued in the corresponding International Application No. PCT/JP2006/313205, mailed on Aug. 22, 2006.

* cited by examiner

*Primary Examiner*—Hoang V Nguyen
(74) *Attorney, Agent, or Firm*—Keating & Bennett, LLP

(57) ABSTRACT

A coil antenna includes a magnetic core and a coil wound around a bobbin which are accommodated within a case. The magnetic core and an end of the bobbin are connected to a cap. The magnetic core and an end portion of the bobbin are covered with a foamed component, and are further covered with a gel component. The foamed component is formed by a forming process, and an adhesive compound is provided between the magnetic core and the foamed component.

15 Claims, 2 Drawing Sheets

COIL ANTENNA

BACKGROUND OF THE INVENTION

1. Field of the Invention

The present invention relates to a coil antenna used for a short distance communication system having an LF band (a long wave with frequencies of about 30 kHz to about 300 kHz).

2. Description of the Related Art

In a short distance communication system with an LF band (a long wave with frequencies of about 30 kHz to about 300 kHz), a coil antenna is made of a coil wound around a magnetic core (the coil antenna itself will be referred to as a winding structure below). The coil antenna is usually encased in a case.

FIG. 1 shows a configuration of a sending coil antenna 1 disclosed in Japanese Unexamined Patent Application Publication No. 2001-358522 (Patent Document 1). The coil antenna 1 includes a magnetic core 2, a bobbin 4 for accommodating the magnetic core 2, and a main coil 3 formed by winding a conducting wire around the bobbin 4. The coil antenna 1 also includes a case 5 accommodating the magnetic core 2, the bobbin 4, and the main coil 3 therein. Around the magnetic core 2, the bobbin 4, the main coil 3, and the case 5, a potting material is provided.

The magnetic core 2 includes a ferromagnetic substance, such as a ferromagnetic Mn—Zn ferrite, an amorphous magnetic substance other than the ferromagnetic Mn—Zn ferrite, and compaction molded magnetic impalpable powder. These magnetic substances have very low toughness and brittle breaking properties. When the toughness is further deteriorated due to the effects of temperature and humidity, the magnetic core 2 may fail when only a small load is applied thereto. Such failure of the magnetic core 2 may cause a change in resonance frequency, which destabilizes the radiant magnetic field of the coil antenna 1.

In Patent Document 1, the case 5 is fully packed with a potting material 10 by vacuum casting while bubbles generated in the potting material 10 are removed (such a conformation without bubbles will be referred to as a degasified component below). Thereby, the magnetic core 2 is prevented from being deteriorated due to temperature and humidity, and the magnetic core 2, the bobbin 4, and the main coil 3 are prevented from coming into contact with the case 5.

By making the degasified component 10 of a flexible rubber material, a static deformation and load applied to the case is absorbed due to the deformation of the degasified component 10, which prevents the magnetic core 2 from being applied to the static deformation and load via the degasified component 10.

However, since the case is packed with such a degasified component without leaving a space, when deformation is generated in or a load is applied to the case momentarily, the degasified component cannot deform (drift) and the responsiveness is not so good. Hence, the deformation and the load are momentarily transmitted to the magnetic core, which leads to damage of the magnetic core.

When the case is filled with the degasified component by the vacuum casting, displacement is generated in the magnetic core due to the deformation of the degasified component during curing, which may cause damage to the magnetic core due to a thin portion of the degasified component or the hardening of the magnetic core having an external force applied thereto.

SUMMARY OF THE INVENTION

To overcome the problems described above, preferred embodiments of the present invention prevent the damage of the magnetic core and provide a coil antenna suitable for an antenna of a short distance communication system with an LF band.

A coil antenna according to a preferred embodiment of the present invention includes a winding structure including a magnetic core and a coil wound around the magnetic core, a cylindrical case accommodating the winding structure therein with one open end and the other closed end, and a cap for fitting into the open end of the case as well as for supporting the winding structure, wherein a foamed component is provided in at least a portion of a space between the winding structure and the case.

The foamed component according to preferred embodiments of the present invention may preferably be a structure in which bubbles are generated inside a viscoelastic material substantially uniformly and in particular, it may preferably be a foam or sponge of urethane foam or silicone foam, or other suitable material.

Since such a foamed component has bubbles inside, in comparison with the above-mentioned degasified component, the deformation and the load can be absorbed faster. Thus, by providing the foamed component in a space between the winding structure and the case, the winding structure is prevented from coming into contact with the case, and absorbs the static deformation and load as well as a sudden load or deformation by a rapid response for preventing damage to the magnetic core.

The foamed component has an extremely light weight because of the bubbles, so that the total weight of the coil antenna is reduced by using the foamed component, which improves the resistance to an impact load, such as a dropping shock.

In the coil antenna according to preferred embodiments of the present invention, the foamed component may be provided in the space adjacent to the closed end of the case.

Thereby, the winding structure is securely prevented from coming into contact with the case.

In the coil antenna according to preferred embodiments of the present invention, the foamed component may be provided in the space from the closed end of the case to the open end.

Even when a load or deformation is suddenly applied to the coil antenna, while the winding structure being prevented from coming into contact with the case, the impact is thereby absorbed extremely efficiently so as to prevent the impact from being transmitted to the magnetic core.

In the coil antenna according to preferred embodiments of the present invention, the foamed component may be formed by a forming process.

Thereby, the end position of the winding structure can be stabilized in the case as compared to that in the cast molding, so that the thickness of the foamed component can be substantially uniform.

In the coil antenna according to preferred embodiments of the present invention, an adhesive compound may be provided between the foamed component and the winding structure.

Thereby, the displacement of the foamed component in the case is securely prevented.

In the coil antenna according to preferred embodiments of the present invention, a gel component may be provided between the foamed component and the case.

Thereby, the winding structure can be more stably secured in the center of the case.

According to preferred embodiments of the present invention, while the winding structure including the magnetic core and the coil is prevented from coming into contact with the case, a static load and deformation is prevented from being transmitted to the magnetic core via the foamed component, and furthermore, a sudden load and deformation is prevented from being transmitted to the magnetic core. That is, substantially no damage to the magnetic core occurs, so that a coil antenna suitable for a short distance communication system with an LF band is provided.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
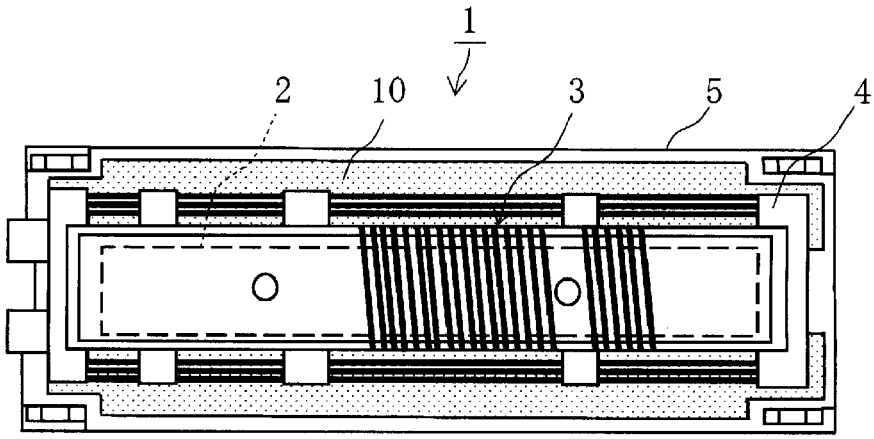
FIG. 1 PRIOR ART
FIG. 1 is a drawing showing a configuration of a conventional coil antenna.
Figure 2A:
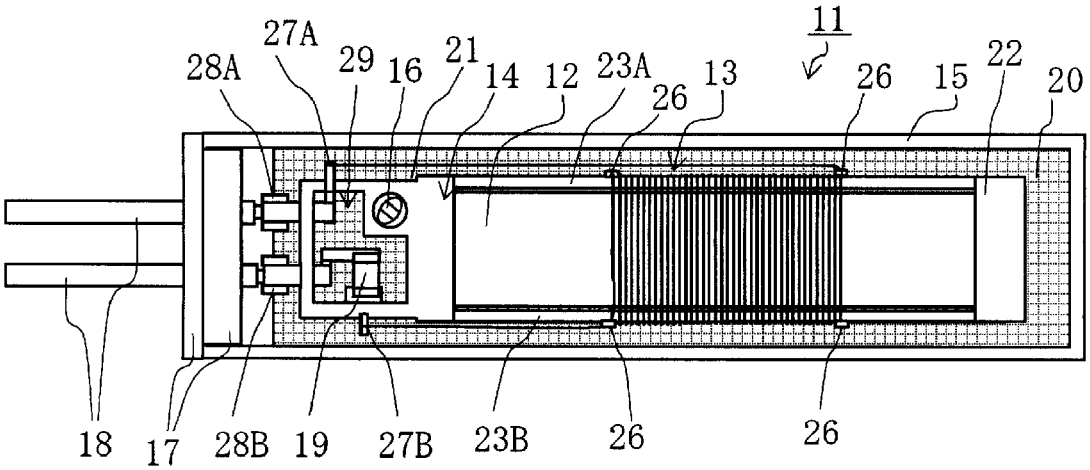
FIGS. 2A and 2B include drawings showing a configuration of a coil antenna according to a first preferred embodiment of the present invention.
Figure 2B:
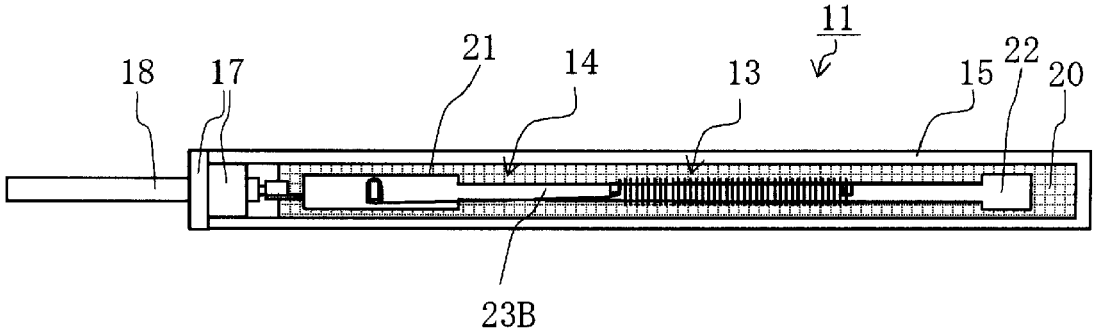

Then, a coil antenna according to a first preferred embodiment will be described with reference to FIGS. 2A and 2B. FIG. 2A is a plan view of a coil antenna 11; FIG. 2B is a front view of the coil antenna 11. In these drawings, portions of a case 15 and a foamed component 20 are transparently displayed.

The coil antenna 11 includes a magnetic core 12 preferably made of ferromagnetic Mn—Zn ferrite. The coil antenna 11 preferably may also include an amorphous magnetic substance other than the ferromagnetic Mn—Zn ferrite and compaction molded magnetic impalpable powder. The magnetic core 12 is preferably a substantially rectangular slab (thin-walled column), and is accommodated within a bobbin 14. Around the bobbin 14 accommodating the magnetic core 12 therein, a coil 13 is wound. The bobbin 14, the magnetic core 12, and the coil 13 herein define a winding structure according to a preferred embodiment of the present invention.

The bobbin 14 protects the magnetic core 12, and suppresses damage to the magnetic core 12 due to a bending load or an impact applied thereto during manufacturing or in use. The bobbin 14 is integrally formed of an end portion 22, a base portion 21, and legs 23A and 23B, using PBT (polybutylene terephthalate).

The end portion 22 and the base portion 21 are connected together with the legs 23A and 23B extending in a longitudinal direction of the magnetic core 12. The end portion 22 has elliptical planes (rectangles with chamfered corners) substantially perpendicular to the longitudinal direction of the magnetic core 12 (planes on the right-and-left sides of the drawing) and an opening (not shown) for accommodating the magnetic core 12 therein. By inserting (press-fitting) the magnetic core 12 into the base portion 21 from the opening, the magnetic core 12 is accommodated within the bobbin 14. Thus, its cross-section is approximately the same as that of the magnetic core 12.

The base portion 21 has elliptical planes (rectangles with chamfered corners) substantially perpendicular to the longitudinal direction of the magnetic core 12 (planes on the right-and-left both sides of the drawing), in the same manner as in the end portion 22. On one of the substantially perpendicular planes (on the right side of the drawing), a groove (not shown) is provided for fitting the magnetic core 12. This groove has approximately the same cross-section as that of the magnetic core 12 for fixing the magnetic core 12. This plane (on the right side of the drawing) is configured so as to be joined to the magnetic core 12. In addition, from this plane (on the right side of the drawing), the legs 23A and 23B are arranged so as to extend in the longitudinal direction of the magnetic core 12.

The base portion 21 is also provided with an opening 29 arranged so as to penetrate a principal plane (at the front of the drawing) of the magnetic core 12. Within the opening 29, distributing terminals are provided and a capacitor 19 is connected to the terminals. By providing the opening 29, the coil antenna 11 has a reduced overall weight, so that the impact resistance against an impact load such as a dropping shock is improved.

The base portion 21 is also provided with input-output terminals 28A and 28B arranged on a plane (on the left side of the drawing) opposing a plane tangent to the magnetic core 12, and an external interconnect line 18 is connected to the input-output terminals 28A and 28B. The base portion 21 is also provided with coil connection terminals 27A and 27B protruding in a lateral direction of the principal plane of the magnetic core 12, and the coil 13 is connected to the coil connection terminals 27A and 27B. The input-output terminals 28A and 28B and the coil connection terminals 27A and 27B are connected together via terminals and devices such as the capacitor 19 are provided in the opening 29.

The coil connection terminals 27A and 27B may also be juxtaposed on one side plane of the base portion 21. The opening 29 is not necessarily required. If the opening 29 is eliminated, the capacitor 19 may not be integrally arranged.

The base portion 21 also includes a hole with a bottom and a small core 16 is accommodated within the hole with a bottom. The small core 16 has an elliptic cylindrical shape and is made of a magnetic material. Since the small core 16 is located at a position at which a flux linkage of the magnetic core 12 passes through, the small core 16 is magnetically coupled to the magnetic core 12. Since the small core 16 has an elliptic cylindrical shape, when it is rotated, the space between the small core 16 and the magnetic core 12 is changed so that the binding power is varied. Thus, the inductance of the coil 13 can be adjusted by the rotation of the small core 16. After the adjustment, the small core 16 is fixed with an adhesive.

The legs 23A and 23B are provided with projections 26 protruding in a lateral direction of the principal plane of the magnetic core 12. The projections 26 are arranged to retain wire when the coil is formed and their positions and the number are appropriately designed in accordance with the winding number of the coil. The projections 26 herein are arranged at an end of the coil 13. By arranging the projections 26, the winding of the coil 13 is facilitated.

A space (opening) surrounded by the above-mentioned base portion 21, the end portion 22, and the legs 23A and 23B is configured to expose the magnetic core 12 therefrom, so that the plate thickness of the entire coil antenna 11 is reduced. Thereby, by reducing the effective winding diameter of the coil 13, the actual resistance of the coil 13 is reduced.

Also, by reducing the weight of the entire coil antenna 11, the impact resistance against an impact load such as a dropping shock is improved.

Shapes of the magnetic core 12 and the bobbin 14 are not limited to the configurations according to this preferred embodiment. For example, the coil may be wound directly around the magnetic core without providing the legs 23A and 23B. Also, the end portion 22 may be eliminated or may be separately provided.

As described above, the magnetic core 12 is accommodated within the bobbin 14, around which the coil 13 is wound. The coil 13 is preferably formed of a coating-insulated wire rod (conductive wire) made of copper (Cu).

The capacitor 19 is connected in series to the coil 13 so as to define an LC series resonance circuit. By using the power supply with the resonance frequency of the resonance circuit, a coil antenna 11 can have a large coil current even under a low voltage, thus achieving a large magnetic output. Such a coil antenna 11 is suitable for a sending coil antenna of a short distance communication system with an LF band.

The coil antenna 11 also includes the case 15 and a cap 17. The case 15 and the cap 17 are molded of PBT (polybutylene terephthalate). The case 15 is preferably substantially cylindrical, and one end thereof is open while the other end is closed.

Within the case 15, the winding structure defined by the bobbin 14, the magnetic core 12, and the coil 13 are accommodated, and the foamed component 20 is bonded on the winding structure. Then, the winding structure having the foamed component 20 bonded thereto is inserted into the case 15.

The cap 17 is provided with through holes allowing two external interconnect lines 18 to pass therethrough, and the through holes are closely filled with a sealing compound (not shown). By hermetically sealing the through holes, the environmental resistance of the coil antenna 11 is improved. The external interconnect lines 18 are fixed with the sealing compound, so that the bobbin 14 and the magnetic core 12 are supported by the cap 17. By fitting the cap 17 into the opening of the substantially cylindrical case 15, the foamed component 20 and the bobbin 14 are enclosed within the case 15 and the cap 17.

In this preferred embodiment, the cap 17 is separately provided from the bobbin 14. Alternatively, even when the cap 17 and the bobbin 14 are integrally molded, the present invention may be desirably incorporated.

The foamed component 20 is preferably made by cutting a sheet of polyurethane foam (Urethane Foam made from INOAC Corporation used herein), and has a pressure sensitive double coated sheet (not shown) bonded on one side. Thereby, the thickness of the foamed component 20 is substantially uniform, so that the end position of the winding structure in the case (the end position adjacent to the closed end of the case) is stabilized.

The inventors have confirmed through experiments that it is desirable that the thickness of the foamed component 20 when it is used in a compressed state be at least about 40% of its original thickness. When the thickness is below about 40% of its original thickness, bubbles inside the foamed component 20 are crushed, so that the absorption performance on a sudden load and deformation is extremely deteriorated. The inventors have also verified the absorption performance using various materials other than the above-mentioned polyurethane foam (Urethane Foam made from INOAC Corporation), in which when the hardness of the foamed component 20 is about 300 N or less, the absorption performance is desirable.

The foamed component 20 covers the winding structure defined by the magnetic core 12, the bobbin 14, and the coil 13 along substantially its entire length from the closed end of the case 15 to the open end. The winding structure is thereby prevented from coming into contact with the case 15. The magnetic core 12 is also protected against an elastic force and an impact applied thereto. In this manner, almost no damage of the magnetic core 12 occurs.

In addition, the material of the foamed component 20 may also be silicone foam other than the polyurethane foam. Also, the foamed component 20 is not necessarily formed by the forming process but also may be molded by casting with the urethane foam or silicone foam.

The foamed component 20 need not substantially completely cover the winding structure defined by the magnetic core 12, the bobbin 14, and the coil 13, and it may also be provided only in the vicinity of the end portion 22 of the magnetic core 12.

Figure 3A:
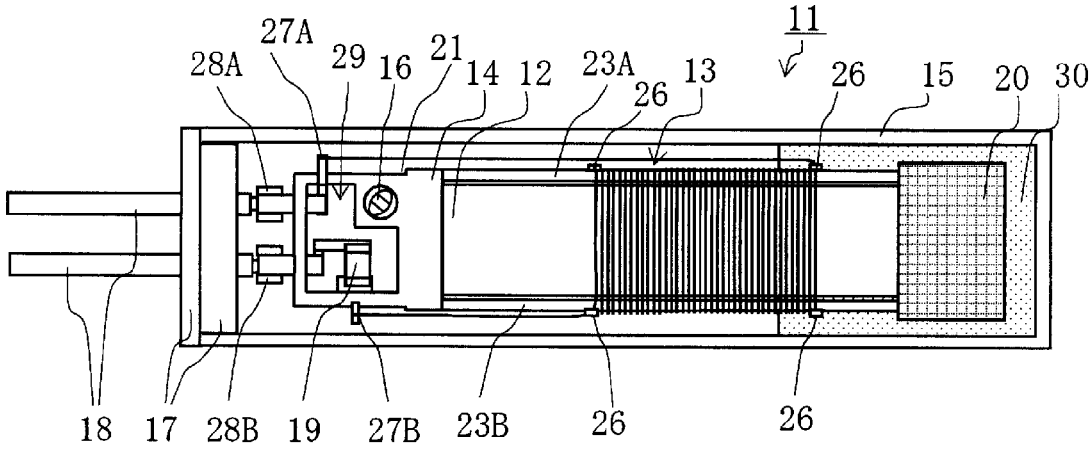
FIGS. 3A and 3B include drawings showing a configuration of a coil antenna according to a second preferred embodiment of the present invention.
Figure 3B:
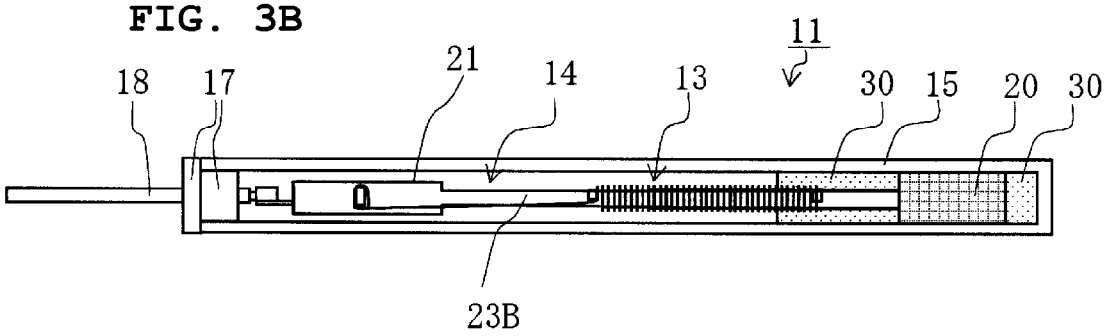

Next, a second preferred embodiment will be described with reference to FIGS. 3A and 3B. FIG. 3A is a plan view of a coil antenna according to the second preferred embodiment; FIG. 3B is a side view of the coil antenna according to the second preferred embodiment. In FIG. 3A, like reference characters designate like components common to those of the above-described first preferred embodiment. In these drawings, portions of a case 15, the foamed component 20, and a gel component 30 are transparently displayed.

A coil antenna 11 according to this preferred embodiment has a configuration similar to that of the above-described first preferred embodiment. However, the shape and composition of the foamed component are different, and a gel component 30 is provided.

The foamed component 20 is a sheet-like component process-formed of polyurethane foam (Urethane Foam made from INOAC Corporation used herein) and has a pressure sensitive double coated sheet (not shown) bonded on one side. With this pressure sensitive double coated sheet, the foamed component 20 is bonded to the vicinity of the bobbin 14 and the end portion 22 of the magnetic core 12.

The gel component 30 is made of a silicone resin (a gel silicone resin made from GE Toshiba Silicones used herein). A sol silicone resin (the gel component 30 prior to curing) is injected into the case 15 in advance. The bobbin 14 having the foamed component 20 bonded thereon is inserted into the case 15. Then, the silicone resin is cured by heat treatment (about 1000° C. for about one hour) so as to transform the sol silicone resin into the gel resin.

When the foamed component 20 is covered with the gel component 30, even if the hardness sufficient for preventing the contact is not obtained by only the foamed component, an appropriate buffer between the end portion 22 and the case 15 is obtained.

The inventors have confirmed with experiments that it is desirable that the gel component 30 cover the case 15 along approximately half or less of the length of the case 15. If the volume of the gel component 30 occupying the case 15 is excessively large, the absorption performance of the gel component 30 on an impact is extremely deteriorated. However, the gel component 30 covers no more than approximately half of the case 15, and furthermore, it covers the bobbin 14 with the foamed component 20 therebetween, so that the fluidity of the gel component 30 is not impaired, and the absorption performance of the gel component 30 is maintained.

The inventors have also confirmed that the thickness of the foamed component 20 when it is used in a compressed state is at least about 40% of its original thickness and the hardness of the foamed component 20 is about 300 N or less.

The material of the gel component 30 may also be an epoxy resin and a urethane resin other than the silicone resin.

When the foamed component 20 uses a type of closed cell foam, the hermeticity and the adiathermancy can be improved. When the foamed component 20 uses a type of open cell foam, excellent impact absorption performance is achieved.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A coil antenna comprising:

a winding structure including a magnetic core and a coil wound around the magnetic core;

a case arranged to accommodate the winding structure therein with one open end and another closed end; and a cap arranged to fit into the open end of the case and to support the winding structure; wherein a foamed component is provided in at least a portion of a space between the winding structure and the case;

the foamed component is formed by a foaming process; and an adhesive compound is provided between the foamed component and the winding structure.

2. The coil antenna according to claim 1, wherein the foamed component is provided in a space adjacent to the closed end of the case.

3. The coil antenna according to claim 1, wherein the foamed component is provided in a space along a length of the case from the closed end to the open end.

4. The coil antenna according to claim 1, wherein the foamed component is made of a sheet of polyurethane film.

5. The coil antenna according to claim 4, wherein the foamed component includes a pressure sensitive double coated sheet bonded to one side thereof.

6. The coil antenna according to claim 1, wherein when the foamed component is provided in at least a portion of a space between the winding structure, the foamed component is compressed no more than about 40% of its original thickness.

7. The coil antenna according to claim 1, wherein the foamed component has a hardness of about 300N or less.

8. A coil antenna comprising:

a winding structure including a magnetic core and a coil wound around the magnetic core;

a case arranged to accommodate the winding structure therein with one open end and another closed end; and a care arranged to fit into the open end of the case and to support the winding structure; wherein a foamed component is provided in at least a portion of a space between the winding structure and the case; and a gel component is provided between the foamed component and the case.

9. The coil antenna according to claim 8, wherein the gel component is a silicone resin.

10. The coil antenna according to claim 8, wherein the foamed component is provided in a space adjacent to the closed end of the case.

11. The coil antenna according to claim 8, wherein the foamed component is provided in a space along a length of the case from the closed end to the open end.

12. The coil antenna according to claim 8, wherein the foamed component is made of a sheet of polyurethane film.

13. The coil antenna according to claim 12, wherein the foamed component includes a pressure sensitive double coated sheet bonded to one side thereof.

14. The coil antenna according to claim 8, wherein when the foamed component is provided in at least a portion of a space between the winding structure, the foamed component is compressed no more than about 40% of its original thickness.

15. The coil antenna according to claim 8, wherein the foamed component has a hardness of about 300N or less.

* * * * *